US005729189A

United States Patent [19]

Oya et al.

[11] Patent Number: 5,729,189

[45] Date of Patent: Mar. 17, 1998

[54] POSITIVE TCR THERMISTOR DEVICE HAVING SURFACE ROUGHNESS AND FILLING OIL FOR HIGH HEAT TRANSFER CHARACTERISTICS

[75] Inventors: Yasuhiro Oya, Nagoya; Keiichi Yamada, Toyoake; Yasuaki Tsujimura, Okazaki; Naoto Miwa, Tsushima, all of Japan

[73] Assignee: Nippondenso Co., Ltd., Kariya, Japan

[21] Appl. No.: 630,506

[22] Filed: Apr. 11, 1996

[30] Foreign Application Priority Data

Apr. 11, 1995 [JP] Japan ..... 7-111143

[51] Int. Cl.[6] ..... H01C 7/10; H01C 7/13

[52] U.S. Cl. ..... 338/22 SD

[58] Field of Search ..... 338/22 R, 22 SD, 338/27

[56] References Cited

U.S. PATENT DOCUMENTS 4,414,052 11/1983 Habata et al. ..... 338/22 R 4,482,801 11/1984 Habata et al. ..... 338/22 R 5,256,857 10/1993 Curhan et al. ..... 338/22 R

FOREIGN PATENT DOCUMENTS 3119302 2/1982 Germany .

61-154003 7/1986 Japan .

62-107261 5/1987 Japan .

2090710 7/1982 United Kingdom .

*Primary Examiner*—Edward Tso

*Attorney, Agent, or Firm*—Cushman, Darby & Cushman IP Group of Pillsbury Madison & Sutro LLP

[57] ABSTRACT

A positive TCR thermistor device has excellent electrical contact between a heat generator and heat radiating blocks and high heat transfer efficiency therebetween. The positive TCR thermistor includes a heat generator having a positive temperature coefficient of resistance and heat radiating blocks supplying electric current to the heat generator and heating a heated medium by receiving heat generated by the heat generator. The heat generator is provided with a metallic paste electrode at a contact surface which is in contact with the heat radiating blocks and oil having flowability is disposed between the metallic paste electrode of the heat generator and the heat radiating blocks.

12 Claims, 5 Drawing Sheets

POSITIVE TCR THERMISTOR DEVICE HAVING SURFACE ROUGHNESS AND FILLING OIL FOR HIGH HEAT TRANSFER CHARACTERISTICS

CROSS REFERENCE TO RELATED APPLICATION

This application is based on and claims priority of Japanese Patent Application No. Hei 7-111143 filed Apr. 11, 1995, the contents of which are incorporated herein by reference.

BACKGROUND OF THE INVENTION

1. Field of the Invention

The present invention relates to a positive TCR thermistor device used in an intake air heating device or the like in an internal combustion engine.

2. Description of Related Art

Conventionally, a heating device including a heating element having a positive temperature coefficient of resistance (TCR) and a radiating block heating a heated body by receiving heat generated by a heat generator including the heating element and providing it to the heated body is known.

The heat generator is made with a PTC element and has an electrode at a contacting surface which is in contact with the radiating block, and the radiating block includes a heat transfer plate and heat radiating fins disposed on the heat transfer plate.

In this heating device, the heat generator and the heat radiating block are disposed in a case or the like having resiliency so as to make the heat-transfer plate on the heat radiating block be in contact with the electrode of the heat generator, as disclosed in Japanese Patent Publication Laid-Open No. Sho 62-107261.

A heating device in which a portion of the device between the heat generator and the heat radiating block is bonded by adhesive has been disclosed in Japanese Patent Publication Laid-Open No. Sho 57-109283.

However, in that heating device, a sprayed-on electrode or a metallic paste electrode formed by metallic paste or the like are usually used for the electrode. The sprayed-on electrode typically has a deeply concave and convex surface. Therefore, a large clearance is formed between the electrode and the heat radiating block on the heat generator, thereby resulting in reduction of heat transfer efficiency between the electrode and the heat radiating block.

The metallic paste electrode has a concave and convex surface which is not as deep as that of the sprayed-on electrode; however, the metallic paste electrode still has a significant clearance between the electrode and the heat radiating block, thereby resulting in further reduction of the heat transfer efficiency.

Conventionally, in a case of the sprayed-on electrode shown in FIG. 9, a heating device 9 including a heat generator 2 having a positive TCR and radiating blocks 3 and 32 heating a heated body by receiving heat generated by the heat generator 2 (which is supplied with electric current) is disclosed. In the heating device 9, the heat generator 2 has an electrode 95 at contacting surfaces 250 in contact with the radiating blocks 3 and 32 and grease 99 is provided in clearances 200 between the electrode 95 and the radiating blocks 3 and 32, as disclosed in Japanese Patent Publication Laid-Open No. Hei 6-123498.

Further, in the heating device 9, since the clearance 200 between the electrode 95 and the heat radiating blocks 3 and 32 is filled with the grease 99, the heat transfer efficiency between the electrode 95 and the heat radiating blocks 3 and 32 is improved.

However, the grease 99 is semi-solid and lacks flowability. Therefore, as shown in FIG. 9, the grease 99 stays between a convex portion 955 at the electrode 95 and the radiating blocks 3 and 32 and electrical contact between the heat generator 2 and the radiating blocks 3 and 32 may be blocked.

Particularly, when the grease 99 is used in the metallic paste electrode, since the metallic paste electrode has a less concave and convex surface than the sprayed-on electrode, the electrical contact can be unstable (see FIG. 6).

Since the grease 99 is semi-solid, bubbles are always formed in an internal portion thereof. In this case, since the bubbles function as clearances, heat transfer efficiency between the heat generator 2 and the heat radiating blocks 3 and 32 will be reduced.

SUMMARY OF THE INVENTION

In view of the foregoing problems, it is a primary object of the present invention to provide a positive TCR thermistor having excellent electrical contact between a heat generator and heat radiating blocks and high heat transfer efficiency therebetween.

In the positive TCR thermistor device having the heat generator having a positive temperature coefficient of resistance and the heat radiating block heating the heated body by supplying electric current to the heat generator and by receiving heat generated by the heat generator, the heat generator is provided with a metallic paste electrode at the contacting surface which is in contact with the heat radiating blocks, and oil having flowability is provided between the metallic paste electrode of the heat generator and the heat radiating blocks.

When the positive TCR thermistor is assembled, the oil can be provided on a surface of the metallic paste electrode disposed on the surface of the heat generator or a surface in contact with the metallic paste electrode of the heat radiating blocks by screen printing, stamp printing or the like. For example, the oil can be provided by blowing with a spray, a nozzle, or the like. Further, the oil can be provided by brushing, impregnating or the like.

For disposition of the oil, when the positive TCR thermistor is assembled, after the heat generator makes contact with the heat radiating blocks, the oil is impregnated between the metallic paste electrode and the heat radiating blocks from a clearance in a side surface or the like. Engine oil, turbo oil, cylinder oil, machine oil, silicon oil, and fluorine oil may be used for the above-described oil.

Next, viscosity of the oil is preferably less than 1 $m^2/s$ (1,000,000 cSt). When the viscosity is larger than 1 $m^2/s$ (1,000,000 cSt), the oil stays between the convex portions at the surface of the metallic paste electrode and the heat radiating block, thereby blocking electrical contact between the convex portion and the heat radiating block.

Next, the boiling point, volatilizing temperature or decomposing temperature of the oil is preferably higher than a heat generating temperature of the heat generator. Therefore, while the positive TCR thermistor is in use, the oil is protected from being lost between the heat generator and the heat radiating block due to decomposing, vaporizing or the like. Silicon oil, fluorine oil or the like which has good heat resistance and is capable of being used at more than 200° C. can be used for the oil having the above-described characteristic.

The heat generator can be constructed by a material having positive temperature coefficient of resistance such as a PTC element or the like. The PTC elements can be made of resin and ceramic.

Especially, the $BaTio_3$ series, $PbTiO_3$ or $V_2O_3$ can be used for the PTC element made of a ceramic; however, a PTC element of $BaTiO_3$ having reduction resistance such as the one disclosed in Japanese Patent Publication Laid-Open No. Sho 61-154003 is preferably used.

The PTC element made of ceramic is not degraded by reduction in a reduction atmosphere formed when oil or the like is decomposed during the use of the positive TCR thermistor, thereby preventing the heat generator from degrading.

The metallic paste electrode can be formed by being applied with metallic paste including, e.g., metallic powder, glass frit, binder, solvent, and the like on a surface of the heat generator by screen printing, brushing or the like and then being dried and seized.

For the metallic powder, for example, Ag, a mixture of Ag and Pd, ohmic Ag, Al, Zn or the like can be used.

As shown in FIG. 1, the heat radiating block can be a heat transfer plate joined to a wave-shaped fin at a bending portion of the wave-shaped fin. In this case, the heat transfer plate is in direct contact with the heat generator.

Other than the wave-shaped heat radiating fin, for example, a honeycomb-shaped heat radiating fin or a heat radiating fin made of a porous metallic mentioned can be used.

The heat generating device can be made by fixing the heat radiating block and the heat generator to a case or the like. At this time, a plurality of heat radiating blocks and heat generators can be received in the case.

The surface roughness of the metallic paste electrode is preferably 20 μm or less. The surface roughness is an average roughness measured according to the JIS B 0601-1982 standard. When the roughness is from 6.3 to 25 μm, a reference length is 2.5 mm. When the roughness is from 25 to 100 μm, the length is 8 mm and when the roughness is from 0.8 to 6.3 μm, the length is 0.8 mm.

When the surface roughness is greater than 20 μm, since a clearance between the metallic paste electrode at the heat generator and the heat radiating block becomes larger, heat transfer efficiency between the metallic paste electrode and the heat transfer block may be reduced.

The positive TCR thermistor according to the present invention is most suitable for an intake heating device of an engine or the like of heavy-duty trucks; however, the device can also be used for a warm air heater or the like in an automotive passenger compartment.

In the positive characteristic thermistor device according to the present invention, oil having flowability is disposed between the metallic paste electrode provided at the heat generator and the heat radiating block. Therefore, the oil is prevented from staying between the convex portion of the metallic paste electrode and the heat radiating block, and therefore, the metallic paste electrode and the heat radiating block are connected firmly and electrical contact between the metallic paste electrode and the heat radiating block can be obtained.

The oil has water repellency, thereby preventing water, salt and the like from entering between the heat generator and the heat radiating block; thus, the oil is capable of preventing the heat generator and the heat radiating block from corroding. Therefore, good electrical contact can be obtained between the heat generator and the heat radiating block.

The clearance between the heat generator and the heat radiating block is filled with the oil, and therefore, the heat transfer efficiency between the heat generator and the heat radiating block is improved. Since the oil has flowability, bubbles are not trapped therein and degradation of the heat transfer efficiency due to the bubbles can be prevented.

According to the present invention as described above, a positive characteristic thermistor device having efficient electrical contact between a heat generator and a heat radiating block and high heat transfer efficiency between the heat generator and the heat radiating block can be provided.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

The preferred embodiments of the present invention are hereinafter described with reference to the accompanying drawings.

A positive TCR thermistor according to an embodiment of the present invention is explained with reference to FIGS. 1 through 4. The positive TCR thermistor in the embodiment is used as an intake air heating device of a diesel engine as shown in FIG. 4.

Figure 1:
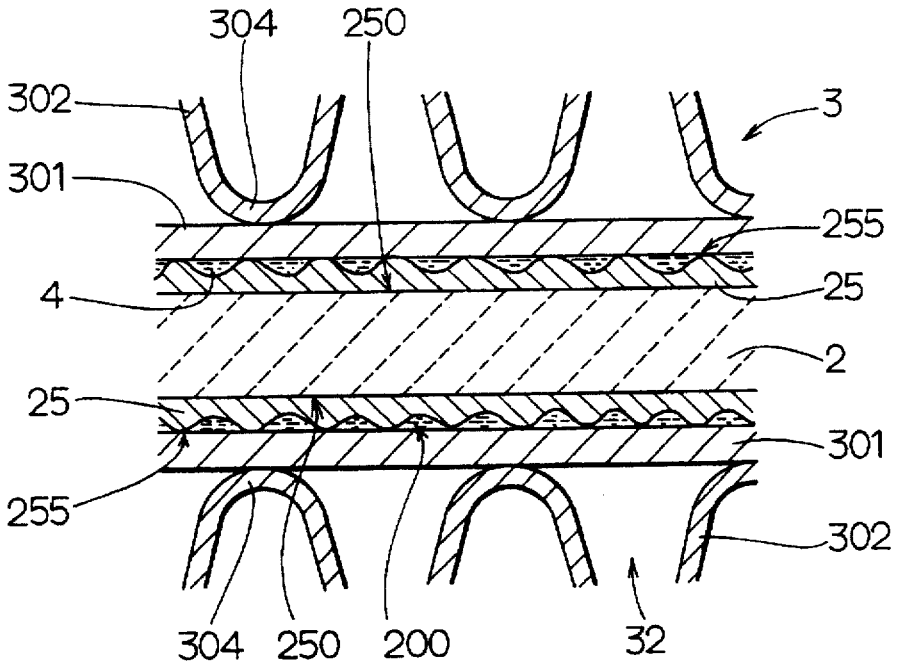
FIG. 1 is an enlarged view illustrating a main portion of a positive TCR thermistor according to an embodiment of the present invention.
Figure 2:
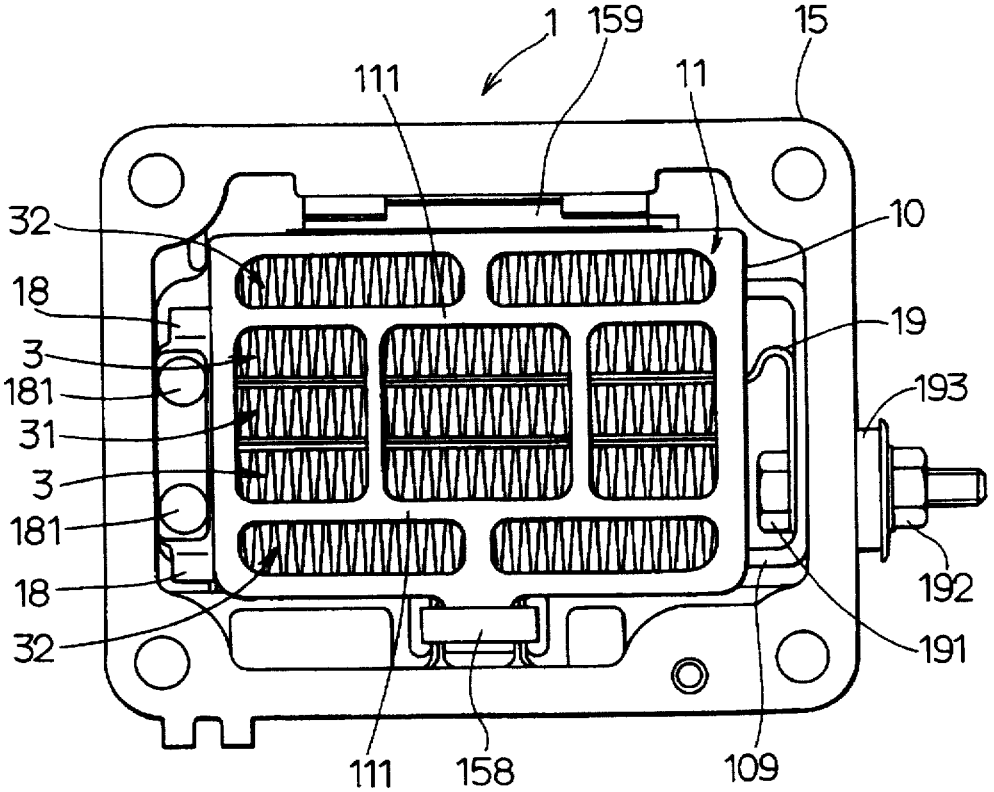
FIG. 2 is a plan view illustrating a positive TCR thermistor according to the embodiment.
Figure 3:
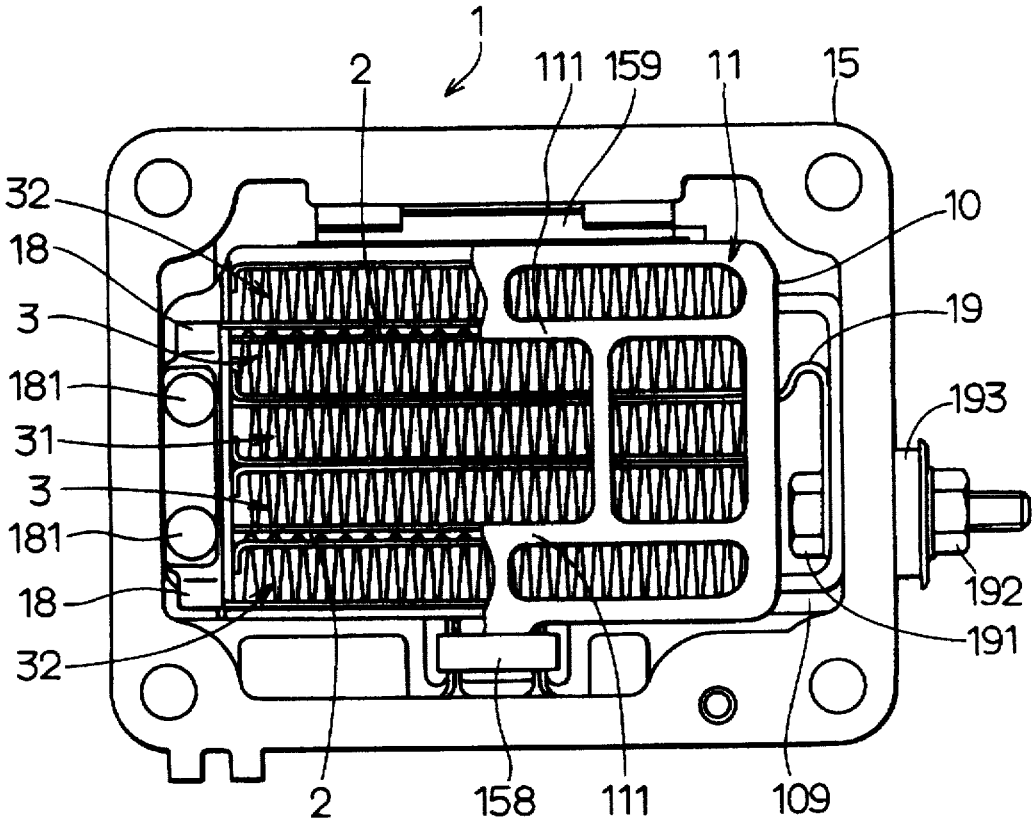
FIG. 3 is a plan view illustrating a cut-away portion of the positive TCR thermistor according to the embodiment.
Figure 4:
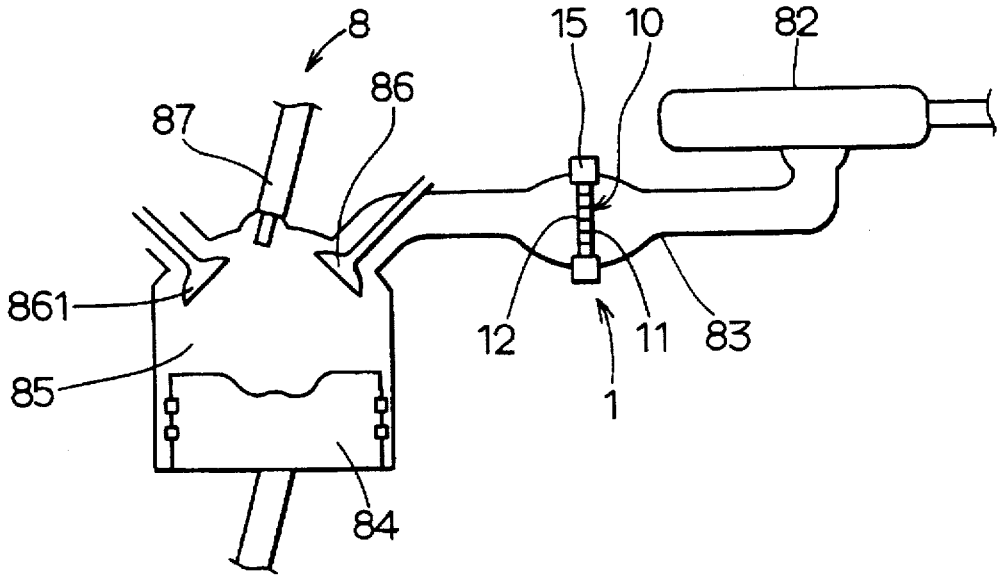
FIG. 4 is an explanatory view illustrating an intake system of a diesel engine employing a positive temperature TCR thermistor according to the embodiment.

As shown in FIGS. 1 through 3, a positive TCR thermistor 1 in the embodiment includes a heat generator 2 having four layers with positive temperature coefficients of resistance and five heat radiating blocks 3, 31, 32 heating a heated body by supplying electric current to the heat generator 2 and receiving heat generated at the heat generator 2.

In the heat generator 2, metallic paste electrodes 25 are provided at contact surfaces 250 in contact with the heat radiating blocks 3 and 32. Further, in the heat generator 2, oil 4 having flowability is disposed in clearances 200 between the metallic paste electrodes 25 and the heat radiating blocks 3 and 32.

The heat radiating block 31, as described later, is provided between the heat radiating blocks 3 and 32 facing the heat generator 2 and is spaced from the heat generator 2.

The oil 4 is diesel engine oil which has viscosity of 1 $m^2/s$ (1,000,000 cSt) at 40° C. as defined in JIS K 2216-1966.

The heat generator 2 is a rectangular planar PTC element which is made from a barium titanate type ceramic sintering body and is 1.5 mm thick. The surface roughness of the metallic paste electrode 25 is 5 μm.

The heat generator 2 having the metallic paste electrodes 25 is manufactured as described below.

Granulated powder having barium titanate is formed and baked at a temperature between 1300° and 1360° C. A surface as a contact surface of the sintered body thus obtained is ground to have a flatness of 5 μm or less so that a ground product which is 1.5 mm thick is obtained. An activating paste having a main ingredient of $PdCl_2$ is printed and baked on both surfaces of the ground product. Electroless Ni plating processing is performed and Ni plating is coated only on a portion of the body to which the activating paste will be applied.

A metallic paste including metallic powder (Ag), glass frit (borosilicate lead, etc.), binder (ethylcellulose, etc.) and solvent (n-butylcarbitol acetate, etc.) is formed, and the metallic paste is applied on both surfaces of the Ni plating product by screen printing to cover the Ni plating. After the metallic paste has dried, it is baked. In this way, the heat generator 2 having the metallic paste electrodes 25 at both surfaces of the heat generator 2 is obtained.

The heat radiating blocks 3, 31, 32 are structured by heat radiating fins 302 formed by bending aluminum plates in a wave shape and aluminum heat transfer plates 301 adhered to bent portions 304 of the heat radiating fins 302 by brazing. The heat radiating blocks 3 and 32 are in contact with the metallic paste electrodes 25 of the heat generator 2 through each heat transfer plate 301 of the heat radiating blocks 3 and 32.

As shown in FIGS. 2 and 3, the positive TCR thermistor 1 has the four layer heat generator 2, a case 10 receiving the five heat radiating blocks 3, 31, 32 and a housing 15 receiving the case 10.

As shown in FIG. 4, a front surface 11 and a back surface 12 of the case 10 each has a frame shape provided with a plurality of windows so that air as a heated medium can pass therethrough without any restrictions. A middle frame portion 111 for sealing side surfaces of contact portions of the heat generator 2 and the heat radiating blocks 3 and 32 is provided at the front surface 11 and the back surface 12 of the case 10.

The case 10 and the middle frame portion 111 are preferably made of heat resistant resin and the housing 15 is preferably made of aluminum.

Next, disposition of the heat generator 2 and the heat radiating blocks 3, 31 and 32 in the case 10 is explained.

The middle heat radiating block 31 not in contact with the heat generator 2 is disposed in the middle of the case 10. Two of the inner heat radiating blocks 3 are disposed to adjoin both sides of the middle heat radiating block 31.

Two heat generators 2 are disposed at outer sides of the inner heat radiating blocks 3 and the outer heat radiating blocks 32 are disposed on opposite sides of the heat generators 2.

The oil 4 is applied on a surface of the metallic paste electrode 25 of the heat generator 2 by screen printing before assembling in the case 10.

A U-shaped resilient member 159 is provided between the case 10 and the housing 15 and the case 10 is pressed from a side surface by a restoring force of the resilient member 159. Hence, the heat generator 2 and the heat radiating blocks 3, 31, 32 received inside the case 10 are in contact with and fastened to one another.

Next, supply of electric current to the heat generator 2 is carried out as described below.

A plus side terminal 19 protrudes from a heat transfer plate 301 of the inner heat radiating block 3 through a notch provided in a lower case (not shown). The plus side terminal 19 is fastened to the housing 15 with a nut 191 and a bolt 192.

The plus side terminal 19 is electrically insulated from the housing by a frame portion of the lower case and an insulator ring 193.

A minus side terminal 18 protrudes from the heat transfer plate 301 of the outer heat radiating block 32 through a notch provided in the lower case (not shown). The minus side terminal 18 is fastened at the housing 15 with a small screw 181 and is grounded to the housing 15.

A clip 158 is for fastening the case 10 to the housing 15.

As shown in FIG. 4, the positive TCR thermistor 1 of the embodiment is used as an intake air heating device which is disposed in an intake system of a diesel engine 8.

The positive TCR thermistor 1 is disposed so that the heat generator 2 is transverse to an air flow direction in an intake manifold portion 83 disposed between the diesel engine 8 and an air cleaner 82.

A piston 84, a combustion chamber 85, an intake valve 86, an exhaust valve 861 and a fuel injection nozzle 87 are shown in FIG. 4.

Heating of intake air by the positive TCR thermistor 1 is carried out as described below.

That is, electric current supplied from a battery (not shown) flows from ground through the small screw 118 on the housing 15 and to the minus side terminal 18. From there, it flows through the heat transfer plate 301 of the outer heat radiating block 332 and the oil disposed thereby, and through the metallic paste electrode 25 on the outer heat radiating block 32 side to reach the heat generator 2. Exiting, it similarly passes through the metallic paste electrode 25 on the inner heat radiating block side, the oil disposed thereby, the heat transfer plate 301 of the inner heat radiating block 31, and the plus side terminal 19.

Therefore, heat is generated at the heat generator 2. The generated heat is transferred to the heat transfer plate 301 and the heat radiating fins 302 of the heat radiating block 3 through the metallic paste electrode 25 and the oil 4.

Thus, the air taken in the diesel engine 8 is heated by passing over the heat radiating fins 302.

Next, an operational effect of the embodiment is explained.

The oil 4 having flowability is disposed in the clearance 200 between the heat generator 2 and the heat radiating blocks 3 and 32 of the positive TCR thermistor 1.

Therefore, the oil 4 is prevented from staying at a convex portion 255 of the metallic paste electrode 25, and the metallic paste electrode 25 and the heat radiating blocks 3 and 32 are joined closely so that efficient electrical contact can be obtained between the metallic paste electrode 25 and the heat radiating blocks 3 and 32.

The oil 4 has water repellency and the frame portion 111 is provided at the front surface of the case 10 to seal the contact portion of the heat generator 2 and the heat radiating blocks 3 and 32.

Therefore, water, salt and the like can be prevented from staying between the heat generator 2 and the heat radiating blocks 3 and 32. Further, the oil 4 can be prevented from leaking from the contact portion of the heat generator 2 and the heat radiating blocks 3 and 32. Hence, the heat generator 2 and the heat radiating blocks 3 and 32 can be prevented from corroding. As a result, reliable electrical contact can be obtained between the heat generator 2 and the heat radiating blocks 3 and 32.

The oil 4 fills the clearance 200 between the heat generator 2 and the heat radiating blocks 3 and 32, and heat transfer efficiency between the heat generator 2 and the heat radiating blocks 3 and 32 is improved. Since the oil 4 has flowability, bubbles are not trapped therein and deterioration in heat transfer efficiency due to the bubbles can be prevented.

Therefore, according to the embodiment, a positive TCR thermistor having reliable electrical contact between a heat generator and heat radiating blocks and high heat transfer efficiency therebetween can be provided.

Although a metallic paste electrode is applied on the Ni plating in the embodiment, the same effect can be obtained by using a single-layer electrode without the Ni plating, such as ohmic Ag paste, Al paste, Zn paste or the like.

TABLE 1 shows efficiencies of positive TCR thermistors having oil disposed between the heat generator 2 and the heat radiating blocks 3 and 32 according to the present invention and TABLE 2 shows efficiencies of positive TCR thermistors having substances other than the oil disposed therein.

TABLE 1

| Samp. # | Kind | Chg. % of inrush curr. | Out. eff. (%) | Determ. |
|---|---|---|---|---|
| 1 | engine oil | −3.2 | 100 | ○ |
| 2 | turbo oil | −3.4 | 100 | ○ |
| 3 | cyl. oil | −3.3 | 100 | ○ |
| 4 | mach. oil | −3.2 | 100 | ○ |
| 5 | cut. oil | −3.5 | 100 | ○ |
| 6 | Si oil | −3.2 | 100 | ○ |
| 7 | F oil | −3.2 | 100 | ○ |

TABLE 2

| Comp. samp. # | Kind | Chg. % of inrush curr. | Out. eff. (%) | Determ. |
|---|---|---|---|---|
| C1 | Si grease | −23.5 | 87 | x |
| C2 | nothing | −24.5 | 80 | x |
| C3 | graphite | −22.8 | 86 | x |

Samples 1 through 7 in TABLE 1 are positive TCR thermistors having the construction described above, and each type of oil shown in TABLE 1 is disposed between the heat generator 2 and the heat radiating blocks 3 and 32.

As shown in TABLE 2, silicon grease is disposed between the heat generator 2 and the heat radiating blocks 3 and 32 in a comparison sample C1; nothing is disposed between the heat generator 2 and the heat radiating blocks 3 and 32 in a comparison sample C2; and a 0.2 mm thick graphite sheet is disposed between the heat generator 2 and the heat radiating blocks 3 and 32 in a comparison sample C3. The sheet is a solid member having resiliency. The remaining structure are the same of the comparison samples C2–C3 as the samples 1 through 7; however, the grease of the sample C1 has surface roughness of 20 μm because electrical contact becomes unstable with the surface roughness of 5 μm.

Testing efficiency of the samples 1 through 7 and the comparison samples C1 through C3 is shown below. Each of the samples and comparison samples is manufactured and each inrush current thereof when 12 VDC is applied thereto is measured by a pen recorder.

Each of the samples and comparison samples are left for 1200 hours in a high temperature and humidity environment. Each inrush current is measured again by using the above-described method.

A change percentage, that is, a change percentage of the inrush current between the inrush current of the samples and the comparison samples just after being manufactured and the inrush current after being left in the high temperature and humidity condition is obtained.

Output of each of the samples and comparison samples at 25° C. with 12 VDC applied to and electric current at an air flow amount of 1 $m^3$/min is measured and power is obtained by multiplication of electric current and voltage. The output efficiency is a percentage with respect to output of a limit value (i.e., an ideal value) of decreasing surface roughness of the electrode in an oil applying condition which is described later in a third embodiment.

Results are shown in Tables 1 and 2.

When the change of the inrush electric current has a negative value, in the high temperature and high humidity environment, it is because water enters between the heat generator and the heat radiating blocks, the heat radiating blocks corrode and electrical contact between the heat generator and the heat radiating blocks deteriorate. That is, the change percentage of the inrush current is 0% when the corrosion does not occur.

The output efficiency represents the quality of heat transfer efficiency between the heat generator and the heat radiating blocks. That is, when the heat transfer efficiency is optimal, the output efficiency is 100.

Thus, in Tables 1 and 2, the samples and the comparison samples in which absolute value of the change percentage of the inrush current is 20% or less and the output efficiency is 90% or more are determined as ○ and the others are determined as X.

As shown in Tables 1 and 2, the samples 1 through 7 of the present invention are determined to have high efficiency because their change percentages are approximately −3% and their output percentages are 100%.

The comparison samples C1 through C3 have change percentages exceeding −20% and output efficiencies ranging from 80 to 87% which is low; therefore, the comparison samples C1 through C3 are determined to be inferior to the samples 1 through 7 of the present invention.

Thus, in the positive TCR thermistor, corrosion of the heat radiating blocks or the like does not occur in a high temperature and humidity condition so that electrical contact between a heat generator and the heat radiating blocks does not deteriorate. Further, the positive TCR thermistor has high heat transfer efficiency between the heat generator and the heat radiating blocks.

Figure 5:
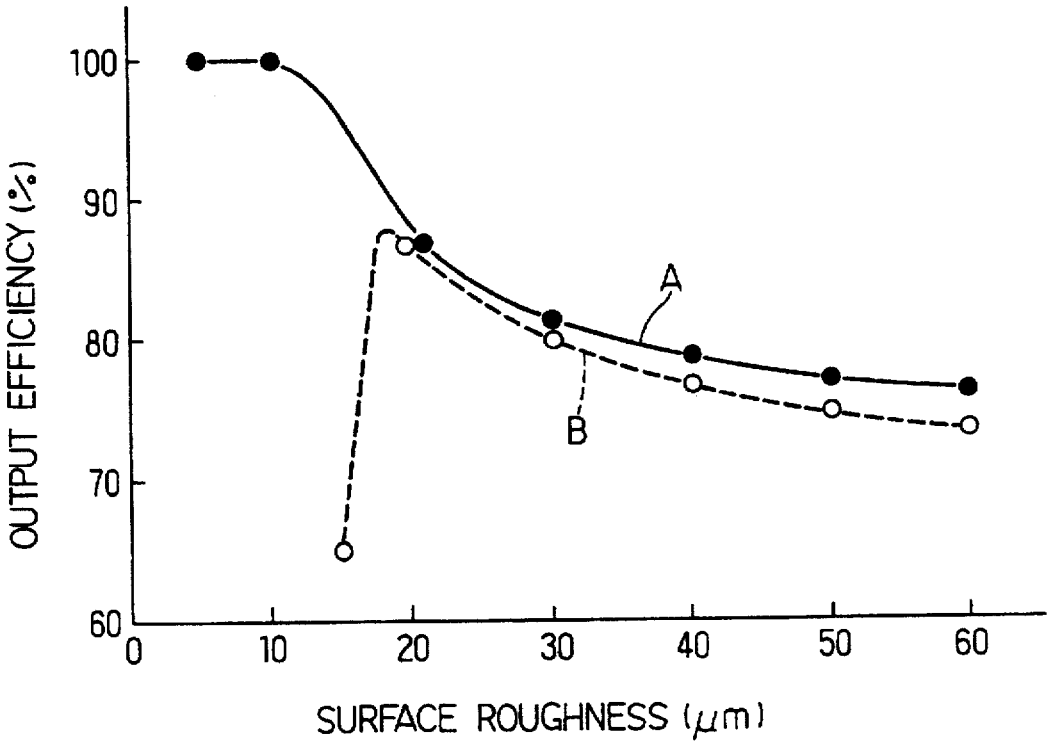
FIG. 5 is a graph illustrating a relationship between output percentage and surface roughness of the positive TCR thermistor according to the embodiment.
Figure 6:
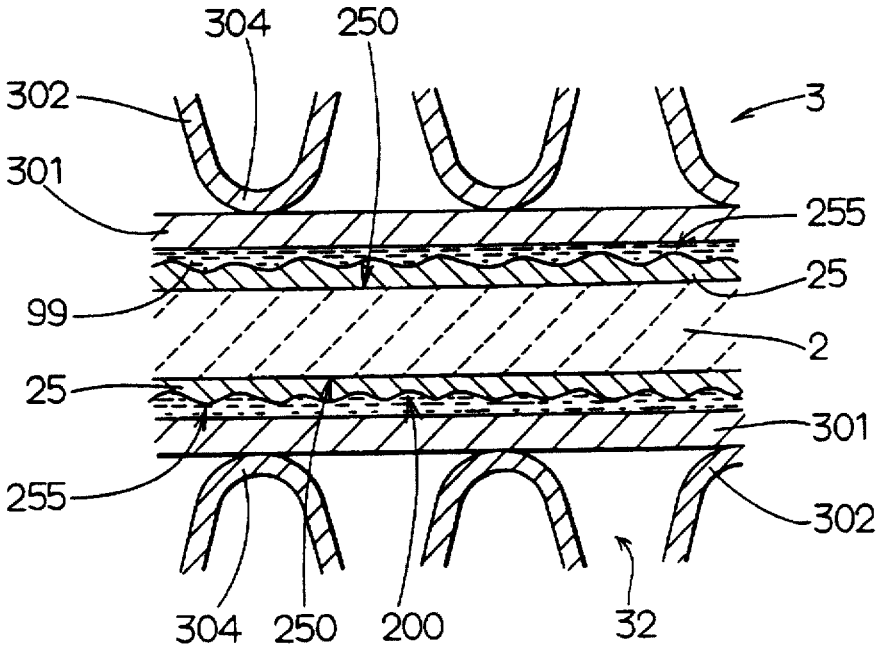
FIG. 6 is an enlarged view illustrating a main portion of a positive TCR thermistor using silicon grease as a comparison according to the embodiment.

FIGS. 5 and 6 show the relationship between the surface roughness and the output percentage of a metallic paste electrode in a positive TCR thermistor having engine oil or silicon grease disposed therein and the relationship is further explained below.

The positive TCR thermistor disposing the engine oil has essentially the same construction as the positive TCR thermistor described in the embodiment (see FIG. 1). The engine oil is the same as the sample 1 in TABLE 1.

As shown in FIG. 6, the positive TCR thermistor having the silicon grease disposed therein has, apart from the use of the silicon grease, the same structure as the positive TCR thermistor in the embodiment. The heat generator 2 is provided with the metallic paste electrode 25 at the contact surface 250 which is in contact with the heat radiating blocks 3 and 32. Further, the silicon grease shown in TABLE 2 as comparison sample C1 in the embodiment is disposed between the metallic paste electrode 25 of the heat generator 2 and the heat radiating blocks 3 and 32.

The output efficiency of each of the positive TCR thermistors in this group is measured by the same method as described above.

The metallic paste electrode in each positive TCR thermistor is formed by using the same method in the embodiment with a difference in the surface roughness. The surface roughness is controlled by a particle size of the metallic powder in the metallic paste.

Measurement results are shown in FIG. 5. The solid line "A" is a result of the positive TCR thermistor having the engine oil disposed therein and the dotted line "B" is a result of the positive TCR thermistor disposing the silicon grease.

As shown in FIG. 5, in the positive TCR thermistor having engine oil disposed therein, when the surface roughness of the metallic paste electrode becomes small, the output ratio is close to 100 and is approximately 100 when the surface roughness is 10 μm or less. Therefore, when the surface roughness is 20 μm or less, the output of a positive TCR thermistor having engine oil disposed therein becomes larger than a device having silicon grease disposed therein, but preferably the surface roughness is 10 μm or less.

When the surface roughness of the metallic paste electrode becomes less than 20 μm, output percentage of the positive TCR thermistor using the silicon grease suddenly decreases.

The relatively poor performance at roughnesses of less than 20 μm is explained as follows. As shown in FIG. 6, silicon grease 99 enters between most parts of the convex portion 255 of the metallic paste electrode 25 and the heat radiating blocks 3 and 32, and the supply of electric current to the heat generator 2 is stopped.

In the positive TCR thermistor having the oil disposed therein, since the oil has flowability, as shown in FIG. 1 in the embodiment, the convex portion 255 is in contact with the heat radiating blocks 3 and 32 firmly and the oil does not stay between the convex portion 255 and the heat radiating blocks 3 and 32.

Thus, when the surface roughness is 20 μm or less, unlike the positive TCR thermistor having silicon grease disposed therein, the surface roughness becomes smaller and a distance between the heat generator 2 and the heat radiating blocks 3 and 32 becomes smaller so that the heat transfer efficiency between the heat generator and the heat radiating blocks is improved, and therefore, the positive TCR thermistor having the oil disposed therein can provide more output than a positive TCR thermistor having silicon grease disposed therein.

Therefore, the positive TCR thermistor having engine oil disposed therein according to the present invention has excellent heat transfer efficiency. On the other hand, the positive TCR thermistor having non-flowable material such as silicon grease disposed therein cannot provide the improvement of the heat transfer efficiency which can be provided by making the electrode surface roughness smaller.

Figure 7:
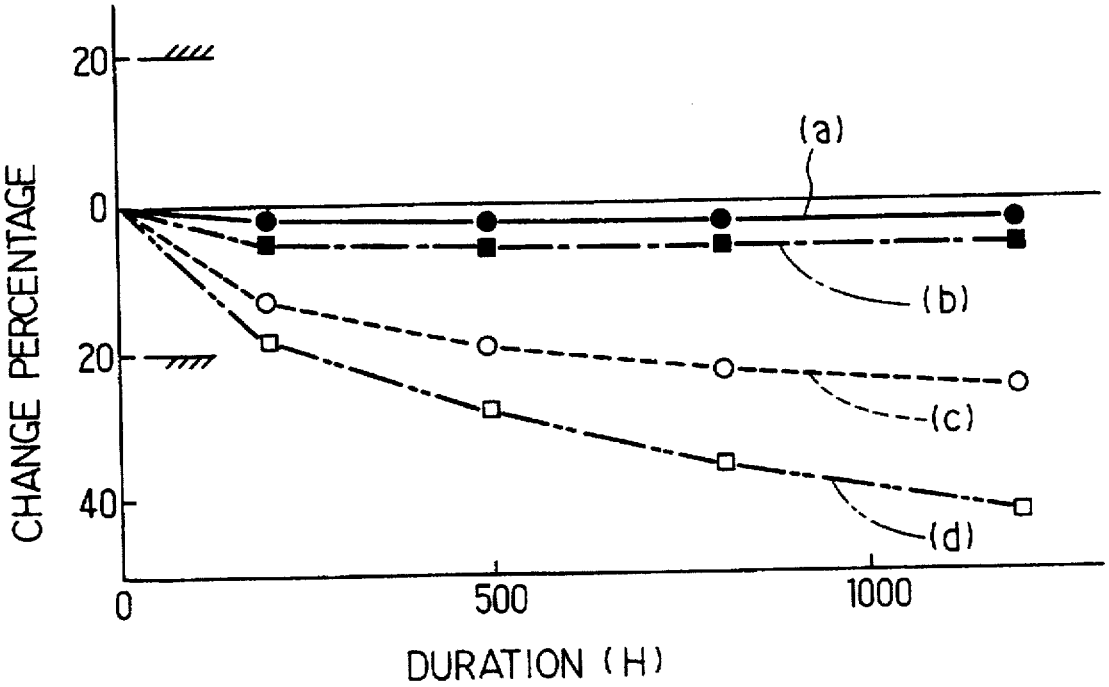
FIG. 7 is a graph illustrating a relationship between a change percentage of inrush current of the positive TCR thermistor and an endurance period at high temperature and high humidity conditions according to the embodiment.

As shown in FIG. 7, each of positive TCR thermistors (a) through (d) having the same structure as described above is tested under high temperature and high humidity conditions.

Each positive TCR thermistor is described below.

The positive TCR thermistor (a) (a solid line in FIG. 7) is a positive TCR thermistor having the engine oil disposed therein (see the sample 1 in TABLE 1) between the heat generator 2 and the heat radiating blocks 3, 32 and having a metallic paste electrode 25 having a surface roughness of 5 μm.

The positive TCR thermistor (b) (a dash-dot line in FIG. 7) is a positive TCR thermistor having the engine oil disposed therein between the heat generator 2 and the heat radiating blocks 3, 32 and having a metallic paste electrode having a surface roughness of 20 μm.

The positive TCR thermistor (c) (a dotted line in FIG. 7) is a positive TCR thermistor having a metallic paste electrode having a surface roughness of 5 μm and having nothing disposed between the heat generator 2 and the heat radiating blocks 3, 32.

The positive TCR thermistor (d) (a dash-double dot line in FIG. 7) is a positive TCR thermistor having a metallic paste electrode 25 with a surface roughness of 20 μm and having nothing disposed between the heat generator 2 and the heat radiating blocks 3, 32.

In the above-described test, each positive TCR thermistor is left under high temperature and humidity conditions at a temperature of 80° C. and a humidity of 95% and change with respect to the change percentage of the inrush current is measured. The measurement results are shown in FIG. 7.

On the assumption that the positive TCR thermistor as shown in FIG. 1 is used for the intake air heating device of the diesel engine, the thermistor device is left under the high temperature and humidity conditions for more than 1000 hours during the test, and absolute value of the change percentage of the inrush current should be 20% or less.

That is, when the inrush current changing percentage is −20% or less, heating temperature is suddenly reduced, startability of the diesel engine deteriorates, and white smoke cannot be reduced.

As shown in FIG. 7, the positive TCR thermistors (c) and (d) having nothing disposed therein do not satisfy the above-described condition. Especially, in device (d) having a large surface roughness of the metallic paste electrode, the change percentage of the inrush current deteriorates to a large degree as time goes by.

However, in the positive TCR thermistors (a) and (b), reduction of the change percentage of the inrush current is small and durability under high temperature and humidity conditions is excellent.

The positive TCR thermistor having engine oil disposed therein according to the present invention is suitable for use in an intake air heating device of a diesel engine.

A relation shown in FIG. 8 between the output and the air amount passing therethrough when air is heated by the positive TCR thermistor is explained below.

That is, using the positive TCR thermistors (a) and (c) at 25° C., DC 12 V is applied thereto at a specified air flow amount and electric current is measured so that electric power is calculated by multiplying the electric current by the voltage.

Generally, the heat generator having the positive temperature coefficient of resistance generates heat by conduction of electricity; however, temperature of the heat generator is stable at a fixed temperature.

When the air is heated by this kind of heat generator, more heat is conducted with every increase in the amount of air exposed to the heat generator so that the temperature of the heat generator is reduced. However, when the temperature is lowered, resistance of the heat generator is reduced and more electric current flows therethrough. Therefore, the temperature of the heat generator rises up to the original temperature, and the heat generator becomes stable.

Therefore, when the air is heated by the positive TCR thermistors (a) and (c), the output is increased as the air amount increases.

Figure 8:
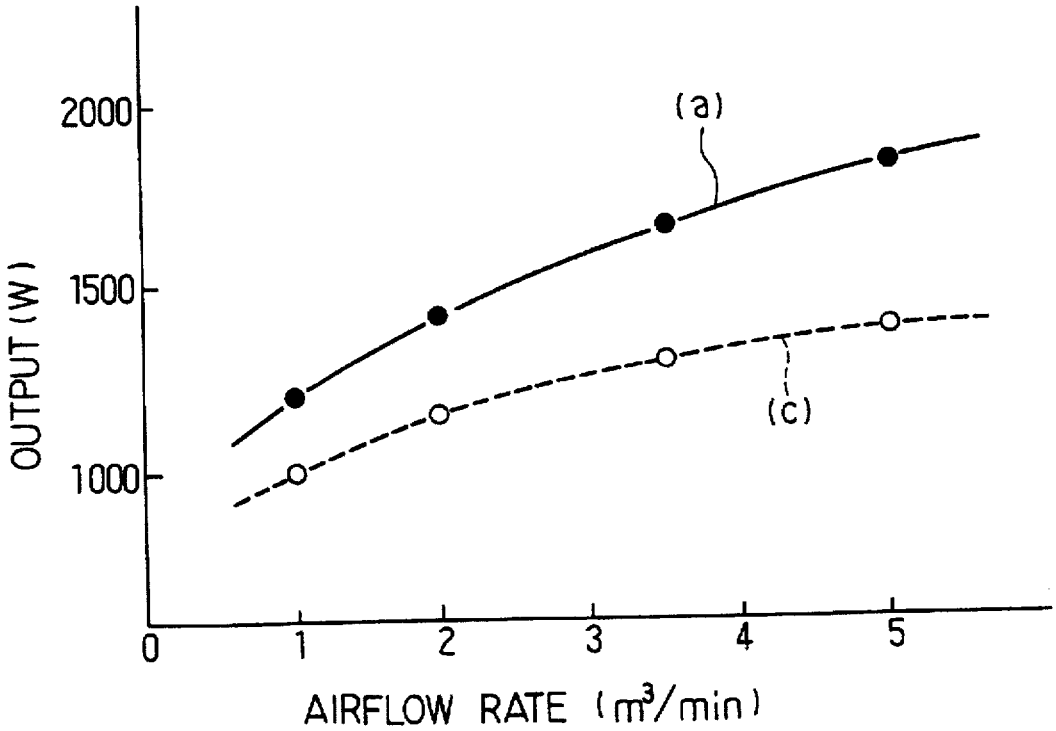
FIG. 8 is a graph illustrating a relationship between an air flow rate and output of the positive TCR thermistor according to the embodiment.
Figure 9:
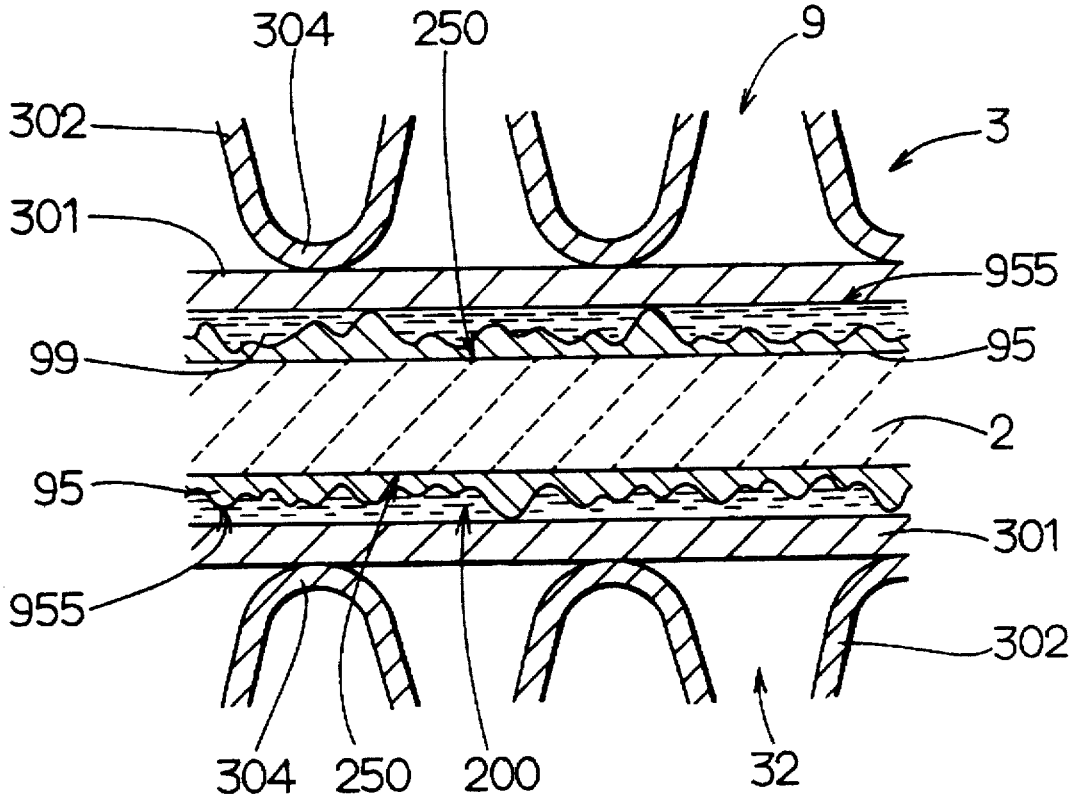
FIG. 9 PRIOR ART
FIG. 9 is an enlarged view illustrating a main portion of a heating device according to the prior art.

As shown in FIG. 8, although the outputs of the positive TCR thermistors (a) and (c) increase with the increasing air amount, the rate of increase of the positive TCR thermistor (a) is larger than the rate of increase of the positive TCR thermistor (c). This tendency is stronger as the air flow amount increases.

Therefore, in the positive TCR thermistor (a), the heat of the heat generator is effectively transferred to the heated body; however, in the positive TCR thermistor (c), the heat of the heat generator cannot be effectively transferred to the heated medium.

Recently, with strengthening of exhaust gas regulations, the provision of the intake air heating device for heavy-duty trucks has increased and the number of positive TCR thermistors used as the intake air heating device has increased. As the engine becomes larger, the engine needs a larger air intake rate. Therefore, the positive TCR thermistor having engine oil disposed therein is useful for the intake air heating device of the heavy-duty trucks.

The present invention having been described should not be limited to the disclosed embodiments, but it may be modified in many other ways without departing from the scope and the spirit of the invention. Such changes and modifications are to be understood as being included with the scope of the present invention as defined by the appended claims.

What is claimed is:

1. A positive temperature coefficient of resistance thermistor comprising:

a heat generator having a positive temperature coefficient of resistance;

an electrode made of metallic paste provided on at least one major surface of said heat generator, said electrode having concave and convex portions at a surface of said electrode and a surface roughness of not more than 20 μm;

an oil layer provided at said concave portions of said electrode, said oil layer including oil having a viscosity of less than 1 $m^2/s$ (1,000,000 cSt) at 25 ° C., and a boiling point, volatiling temperature and decomposing temperature which are higher than a heat generating temperature of said heat generator;

a metallic plate facing a surface of said heat generator, said metallic plate being in electrical contact with said electrode; and a heat radiating block disposed proximate to said metallic plate, said heat radiating block heating a medium by receiving heat generated by said heat generator.

2. A positive temperature coefficient of resistance thermistor according to claim 1, wherein said oil includes at least one of engine oil, turbo oil, cylinder oil, machine oil, cutting oil, silicon oil and fluorine oil.

3. A positive temperature coefficient of resistance thermistor according to claim 1, wherein said oil is provided only at said concave portions of said electrode.

4. A positive temperature coefficient of resistance thermistor according to claim 1, wherein said heat generator includes a positive temperature coefficient element.

5. A positive temperature coefficient of resistance thermistor comprising:

a heat generator having a positive temperature coefficient of resistance;

electrodes disposed at both sides of said heat generator, said electrodes having a surface roughness of not more than 20 μm;

a plate provided on at least one major surface of said heat generator opposite one of said electrodes, said plate being in electrical contact with said heat generator and facing a major surface of said heat generator;

an oil layer filling a clearance between a concave portion of said electrode and said plate, said oil layer including oil having a viscosity of 1 $m^2/s$ (1,000,000 cSt) or less at 25° C.; and a wave-shaped heat radiating block disposed on said plate, said heat radiating block being in electrical contact with said heat generator and heating a medium by receiving heat from said heat generator.

6. A positive temperature coefficient of resistance thermistor according to claim 5, wherein said plate is in direct physical contact with said one of said electrodes.

7. A positive temperature coefficient of resistance thermistor according to claim 5, wherein said heat generator includes a PTC element.

8. A positive temperature coefficient of resistance thermistor according to claim 5, wherein said electrode, are provided at both sides of said heat generator and said plate is provided to face both major surfaces opposing said heat generator.

9. A method of manufacturing a thermistor, said method comprising the steps of:

disposing a paste electrode on a side of a heat generator including a positive temperature coefficient element, said paste electrode having a surface roughness of not more than 20 μm;

disposing a heat transfer block proximate to said paste electrode on a side of said paste electrode opposite said heat generator so that at least portions of a surface of said paste electrode facing said heat transfer block contact said heat transfer block; and disposing oil having a viscosity of less than 1 $m^2/s$ at 25° C. and a boiling point, volatiling temperature and decomposing temperature higher than a heat generating temperature of the heat generator in spaces between said paste electrode and said heat transfer block.

10. The method of claim 9, wherein said paste electrode disposing step is a step of screen printing said paste electrode on said heat generator.

11. The method of claim 9, wherein said paste electrode disposing step is a step of stamp printing said paste electrode on said heat generator.

12. The method of claim 9, wherein said flowable medium disposing step is performed after said heat transfer block disposing step.

* * * * *